US009931541B2

(12) United States Patent
Gacek

(10) Patent No.: US 9,931,541 B2
(45) Date of Patent: Apr. 3, 2018

(54) HAND PADDLE

(71) Applicant: Rafal Gacek, Breda (NL)

(72) Inventor: Rafal Gacek, Breda (NL)

( * ) Notice: Subject to any disclaimer, the term of this patent is extended or adjusted under 35 U.S.C. 154(b) by 0 days.

(21) Appl. No.: 15/122,614

(22) PCT Filed: Feb. 26, 2015

(86) PCT No.: PCT/IB2015/051489

§ 371 (c)(1),
(2) Date: Aug. 30, 2016

(87) PCT Pub. No.: WO2015/132704

PCT Pub. Date: Sep. 11, 2015

(65) Prior Publication Data

US 2017/0065854 A1 Mar. 9, 2017

(30) Foreign Application Priority Data

Mar. 4, 2014 (PL) ..... P.407391
Feb. 9, 2015 (PL) ..... P.411154

(51) Int. Cl.
*A63B 31/04* (2006.01)
*A63B 31/10* (2006.01)

(52) U.S. Cl.
CPC ..... *A63B 31/10* (2013.01); *A63B 2208/03* (2013.01); *A63B 2244/20* (2013.01)

(58) Field of Classification Search
CPC ..... A61B 31/08; A61B 31/10; A61B 31/02
See application file for complete search history.

(56) References Cited

U.S. PATENT DOCUMENTS 1,715,571 A * 6/1929 Galloway
Robertson ..... A63B 31/08 441/58
2,555,969 A 6/1951 Holcolmbe
2,556,894 A * 6/1951 Axiotes ..... A63B 31/04 441/56
3,397,414 A 8/1968 Webb
4,907,519 A * 3/1990 Gil ..... A63B 31/11 441/61
5,147,233 A * 9/1992 Hannula ..... A63B 31/10 441/56

FOREIGN PATENT DOCUMENTS

BR PI1 000548 A2 11/2011
GB 274669 A 7/1927

OTHER PUBLICATIONS

International Search Report for PCT/IB2015/051489 dated Jun. 18, 2015.

* cited by examiner

*Primary Examiner* — Andrew Polay
(74) *Attorney, Agent, or Firm* — Ralph E. Jocke; Joseph L. Powell; Walker & Jocke

(57) ABSTRACT

In a hand paddle (1) comprising a plastic element (10) and at least one attachment element (16) used to attach the hand paddle (1) to swimmer's hand, the flat element (10) is fabric (11) padded along a periphery or rim (12) at least at the front (17) and along the sides (18) by a stiffening element (20). In particular, the stiffening element, around the swimmer's hand, is horseshoe-shaped or flattened-arch-shaped.

16 Claims, 8 Drawing Sheets

HAND PADDLE

TECHNICAL FIELD

The subject of the invention is a hand paddle used in particular in competitive, as well as in recreational swimming.

BACKGROUND ART

A hand paddle, also known as a swim paddle, usually refers to an element made from hard material, usually bigger than a hand in size, appropriately profiled and attached to the hand with elastic straps or cords. The use of hard material increases the resistance of the hand during swimming, therefore the hand paddles are excellent means to develop and improve muscle strength. Hand paddles profiles may contain openings or special slots allowing water to flow through the hand paddle. The resistance created by the hand paddle while swimming is regulated by changing the size of the hand paddle. For instance, in order to force a swimmer using the hand paddle to work harder with each underwater movement made with the hand paddle, a surface of the paddle needs to significantly exceed the size of their hand.

From the patent publications U.S. Pat. No. 2,745,119 A, CA969571 A1, U.S. Pat. No. 5,511,998A and U.S. Pat. No. 7,179,146 B2, hand paddles made entirely from hard, inflexible material, for example from acrylonitrile-butadiene-styrene copolymer (ABS) are known.

From the publication of industrial design description TWM 265076 U and the patent specification DE 4416760 A1, special gloves which allow a swimmer to increase the resistance of a hand are known. The gloves are used mainly in recreational swimming, fitness and aqua-aerobics. They are hardly ever used for sports training of swimmers due to the fact that the position of the hand and fingers in such the glove is not suitable for competitive swimming. The position of the fingers in such a glove is forced by its shape and size, so the fingers are widely spread in order to achieve a maximum working surface in regard to the hand's impact on water. If the cutting of the glove allows the fingers to be put together, the change of the working surface is significant and it is not used in full, as with the fingers spread out, the working surface is significantly larger than with the fingers held together, thus the resistance of the hand in water changes significantly.

The abovementioned examples of hand paddle embodiments usually have complicated shapes and are difficult to adapt to the swimmer's hand.

AIM OF THE INVENTION

The purpose of the invention is to create a hand paddle whose shape would not be complicated. It would be preferable or advisable for the hand paddle to be adaptable to a swimmer's hand and to achieve the best possible adherence to the swimmer's hand, so that the pressure of the paddle is distributed across a surface of the swimmer's hand to the highest possible extent.

DISCLOSURE OF THE INVENTION

According to an idea of the invention, in a hand paddle, comprising a flat element and at least one fastening or attachment element used to attach the hand paddle to a hand of a swimmer, the flat element is fabric stiffened at a rim or periphery along its front and sides by means of a stiffening element.

Preferably, the fabric is a single-layer woven element, in particular a single-layer woven fabric.

The fabric may be a multi-layer woven element or multiple layers of fabric.

It is advisable to the flat element has a horseshoe-shaped or flattened-arch-shaped contour.

The flat element may have a polygon-shaped contour.

At a rear of the fabric, at the rim or periphery unattached to the stiffening element, a securing strap or strip may be attached, in particular a silicone strip, in order to protect a swimmer's wrist from abrasions.

Preferably, the stiffening element is a horseshoe-shaped pressing down or clamping profile attached releasably or separably at the rim or periphery of the front and along the sides to the fabric.

Preferably, a central stiffening profile is placed between an upper stiffening profile and a lower stiffening profile, both horseshoe-shaped, while between the central stiffening profile and the lower stiffening profile the fabric is placed releasably or separably at the rim or periphery at the front and along the sides.

In one of the preferred solutions, the stiffening element may be a frame-shaped horseshoe-shaped pressing down profile, attached permanently at the rim or periphery at the front and along the sides to the fabric.

Preferably, the frame-shaped pressing down profile permanently attached to the fabric is placed between the upper stiffening profile and the lower stiffening profile, both horseshoe-shaped.

Preferably, the fabric has openings or eyelets.

Preferably, the fastening or attachment element in the form of an elastic strap is attached to the fabric or to the stiffening element.

Preferably, the fastening or attachment element in the form of an elastic strap or a hose is attached to the fabric.

Preferably, the stiffening element is closed at the rear with a crossbar, and the frame of the hand paddle is closed-shaped.

Preferably, the fabric at the front and along the sides is folded and sewn together along the rim or periphery, creating a tunnel or tubing formed from the fabric along the rim or periphery, while the stiffening element is an oblong, flexibly-deformable element inserted into the tunnel.

BRIEF DESCRIPTION OF THE DRAWINGS

The invention will be presented in embodiments with a reference to the drawings appended, in which.

MODE(S) FOR CARRYING OUT THE INVENTION

Figure 1:
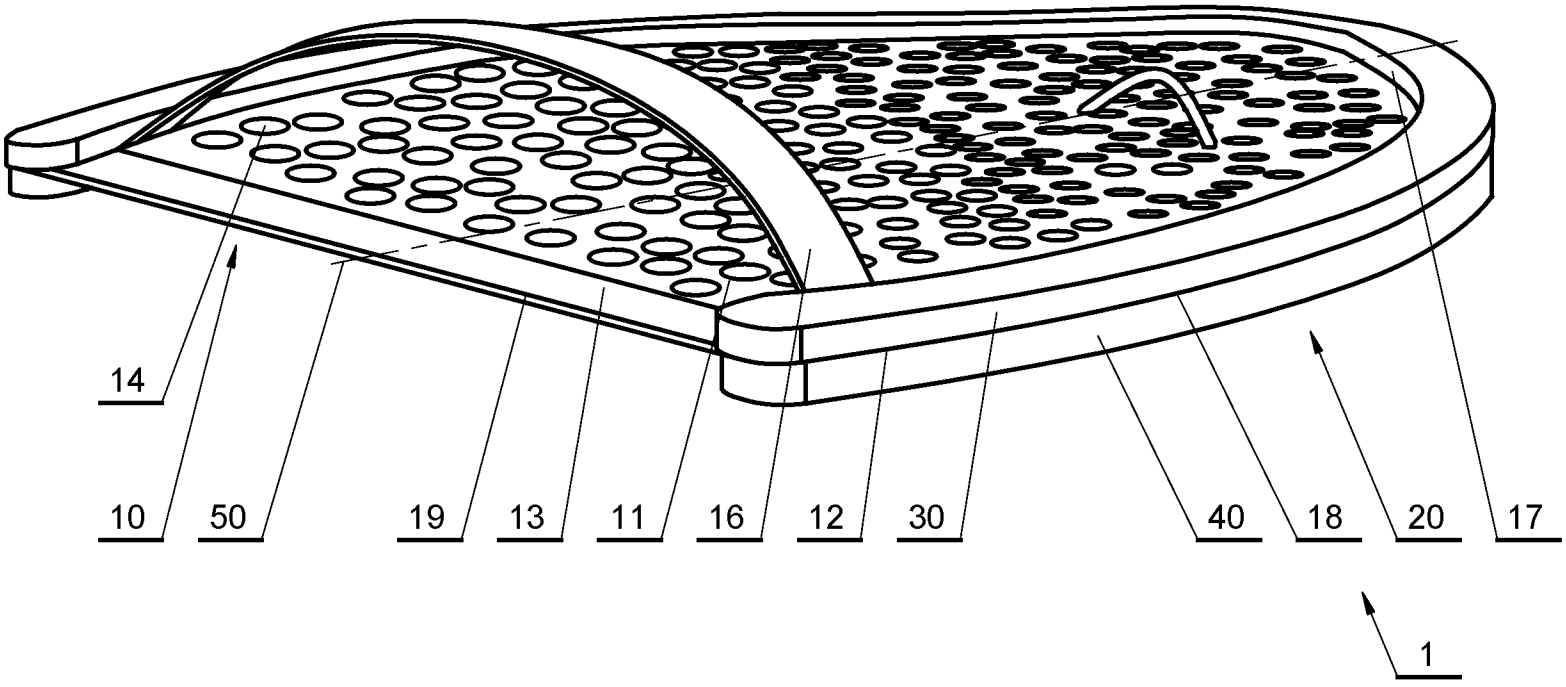
FIG. 1 shows an axonometric view of a hand paddle.
Figure 2:
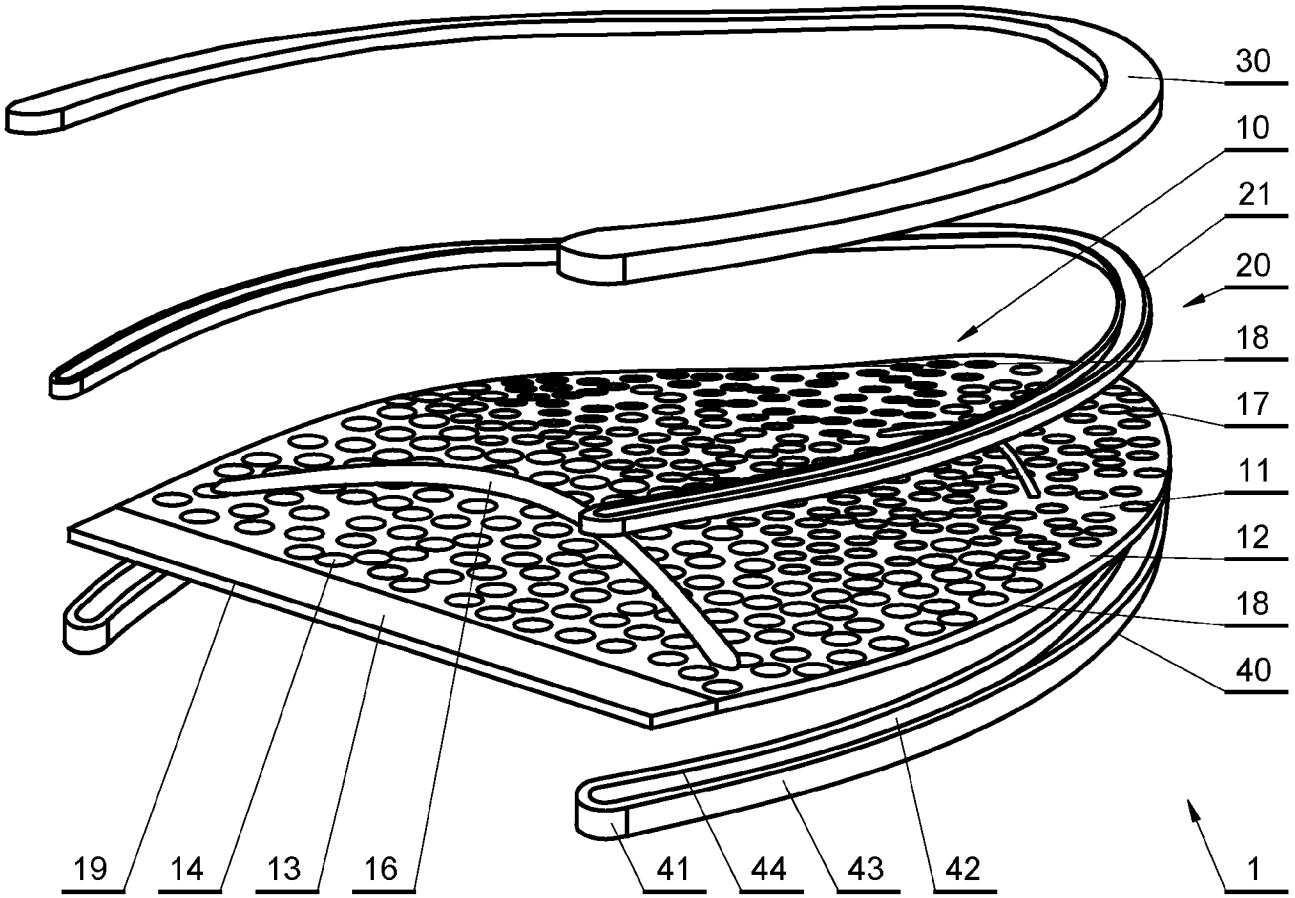
FIG. 2 presents an exploded view of the hand paddle.

A hand paddle 1 shown in FIGS. 1 and 2, with a longitudinal axis 50, comprises a flat element 10 and at least one fastening or attachment element in order to attach the paddle to a swimmer's hand. The flat element 10 in this embodiment is fabric 11 with openings or eyelets 14 allowing water to flow through the hand paddle, stiffened at a periphery or rim 12 along a front 17 and sides 18 using a stiffening element 20. The fabric, which has a smaller stiffness than the stiffening element, adapts to the swimmer's hand during swimming and, in comparison to the currently known hand paddles, adheres to the swimmer's hand on a larger surface, without pressure being localised to single areas. In order to increase the stiffness of the fabric and to decrease its formability, the fabric may be stretched while being attached to the stiffening element. The fabric 11 at a rear 19 at the periphery 12 unattached to the stiffening element 20, is attached to a securing strip 13. Firstly, the securing strip 13 protects the non-stiffened rear 19 of the flat element 10 from fraying of the fabric 11, preventing threads, from which the fabric 11 is made, from warping. Secondly, the securing strip 13 stiffens slightly the rear 19 of the flat element 10. As the securing strip 13 may be made from soft, slightly stretchy plastic, it protects a swimmer's wrist from abrasions. In the embodiment in FIGS. 1 and 2 the securing strip 13 is made of a silicone strip. In the solution presented, the securing strip 13 covers the periphery 12 of the rear 19 of the flat element 10 only at a top side, which is the side facing to the swimmer's hand. In other solutions, the securing strip 13 may be bent and may cover the periphery or rim 12 on a bottom side, which is the resistance side, affected by the resistance of water during movements of the hand paddle 1. The securing strip 13 in yet another solution is an element of a U-shaped cross-section, which is put onto the periphery or rim 12 at the rear 19. To the fabric 11 is attached a strip or a hose 16 made from plastic, for example from silicone, with which the hand paddle 1 is attached to the swimmer's hand.

Therefore, in this embodiment the flat element 10 is susceptible to forces generated during movement of the swimmer's hand and, in particular, it may bend, the fabric 11, from which the flat element 10 is made, is stiffened at the periphery or rim 12 at the front 17 and along the sides 18 with the use of the stiffening element 20. In the embodiment presented in FIGS. 1 and 2, the fabric 11 is separably attached to the stiffening element 20, which contains a central pressing down or clamping profile 21 made from a flat bar or a closed profile, an upper stiffening profile 30 and a lower stiffening profile 40. The upper stiffening profile 30 and the lower stiffening profile 40 having a shape corresponding to the central pressing down profile 21. In particular, when the central pressing down profile 21 is horseshoe-shaped, then the upper stiffening profile 30 and the lower stiffening profile 40 are horseshoe-shaped. The lower stiffening profile 40 in this embodiment has a groove 42 of a width corresponding to the width of the central pressing down profile 21, increased by two thickness of the fabric, an outer wall 43 of the groove 42, an inner wall 44 of the groove 42 and an end 41. After placing the fabric's peripheral or rim in the groove 42 of the lower stiffening profile 40 the fabric is immobilised inside the groove by the central pressing down profile 21, which is pressed against the lower stiffening profile 40 by the upper stiffening profile 30. In another embodiment, the periphery or rim of the fabric is placed between the upper stiffening profile 30 and the lower stiffening profile 40, whose surfaces placed opposite to each other may be flat or profiled, for example, when the lower stiffening profile has a groove, the upper stiffening profile has a projection which is matched with its shape to the groove, due to which the friction force between the fabric and both profiles is increased, which prevents local broken away of the fabric from between the profiles. Both profiles may be joined together by means of bolts and nuts or screws, or both profiles may be glued together with the periphery or rim of the fabric placed between them.

Figure 3:
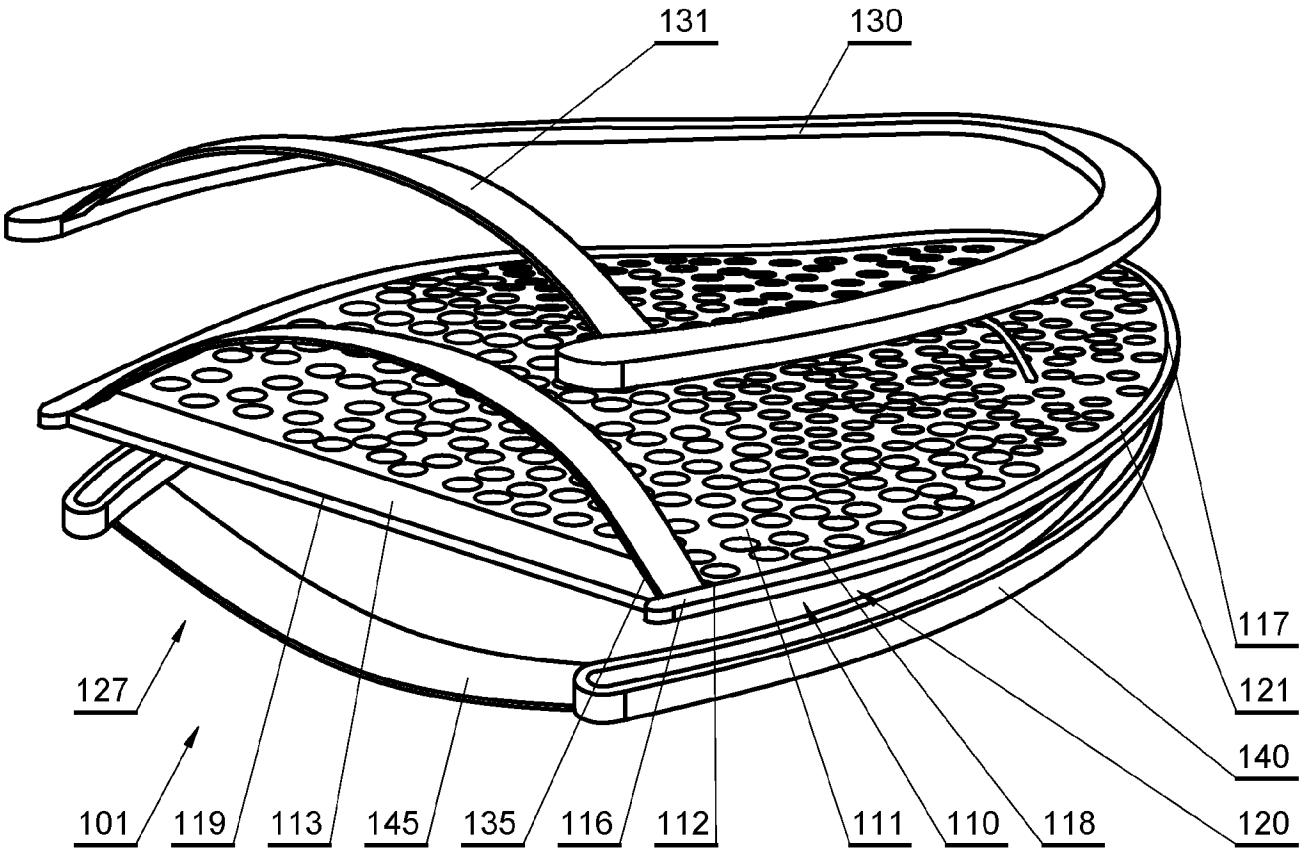
FIG. 3 presents an exploded view of a hand paddle in another embodiment.
Figure 4:
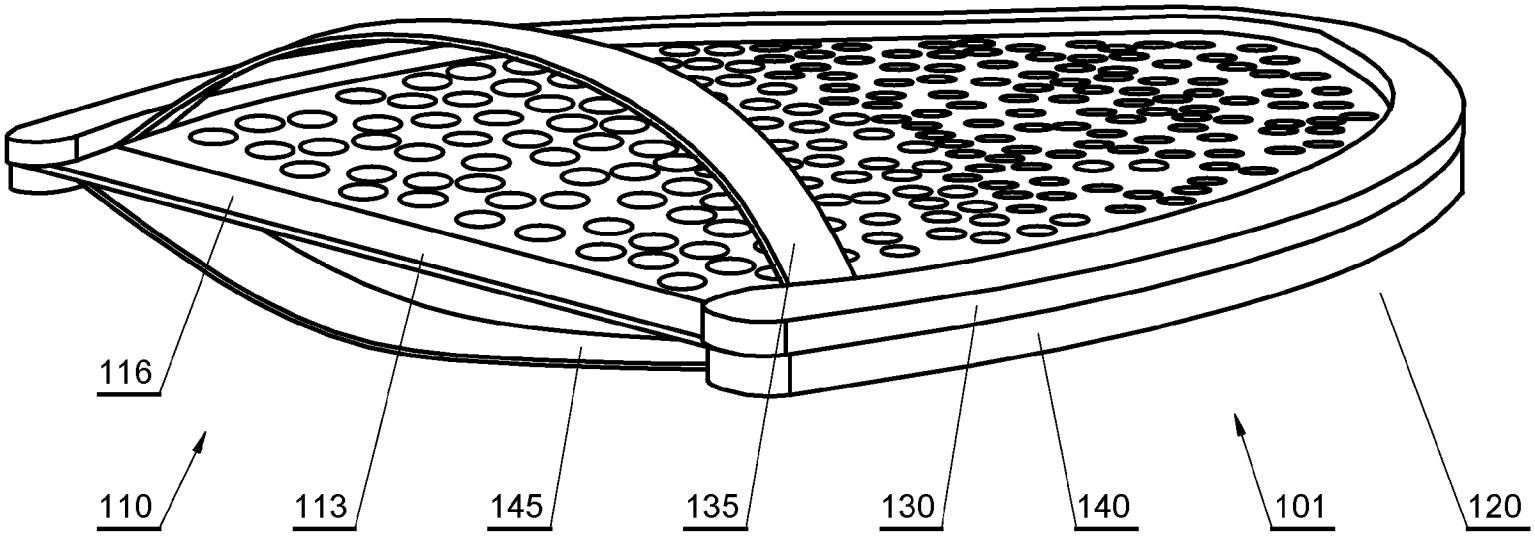
FIG. 4 presents a view of the hand paddle in another embodiment.

In the embodiment shown in FIGS. 3 and 4 a flat element 110, which is fabric 111, is stiffened at a periphery or rim 112 at a front 117 and along sides 118 by means of a stiffening element 120, which is a frame-shaped central stiffening profile 121, permanently attached to the fabric 111. To the fabric 111 at a rear 119 at the periphery or rim 112, which is not attached to the stiffening element 120, is attached a securing strip 113. In order to increase the stiffness of a hand paddle 101 in FIG. 3, the stiffening frame-shaped profile 121 may be placed between an upper stiffening profile 130 and a lower stiffening profile 140, similarly to the hand paddle 1 in FIGS. 1 and 2. The complete hand paddle 101, shown in FIGS. 3 and 4, also has additional fastening or attachment strips 131, 135, 145, by which the hand paddle 101 is attached to the swimmer's hand. The central fastening or attachment strip 135 shown in FIG. 3 is attached to the frame-shaped central stiffening profile 121 next to an additional fastening or attachment strip 116, which may adhere to the securing strip 113 shown in FIG. 4. In another embodiment, the central attachment strip 135 may be attached to the fabric 111 and create together with a plastic tube, for example made from silicone, and with the upper attachment strip 131, an attachment system 127 to attach the swimmer's hand to the hand paddle 101. In order to enable the hand paddle 101 to self-cleaning, the lower stiffening profile 140 is attached to the lower attachment strip 145, which enables attachment of the fabric 111 with its bottom side facing the swimmer's hand together with the central frame-shaped stiffening profile 121. Impurities previously gathered on a top side of the fabric 111 will detach from the fabric 111 caused by water reaction during swimming.

Figure 5:
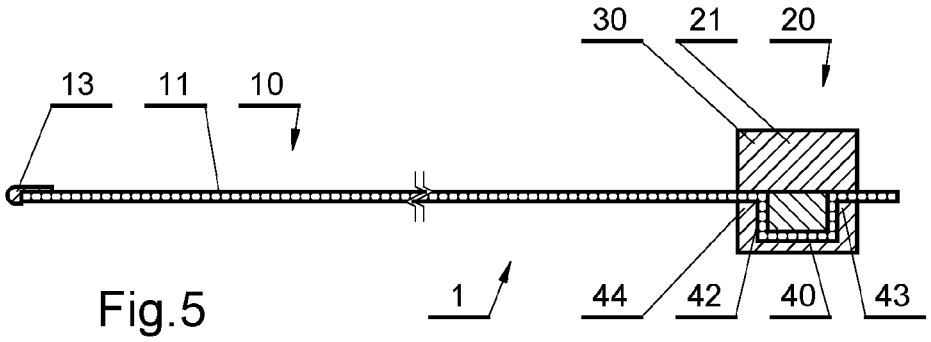
FIGS. 5, 6, 7 and 8 present longitudinal sections of hand paddles in different embodiments.
Figure 9:
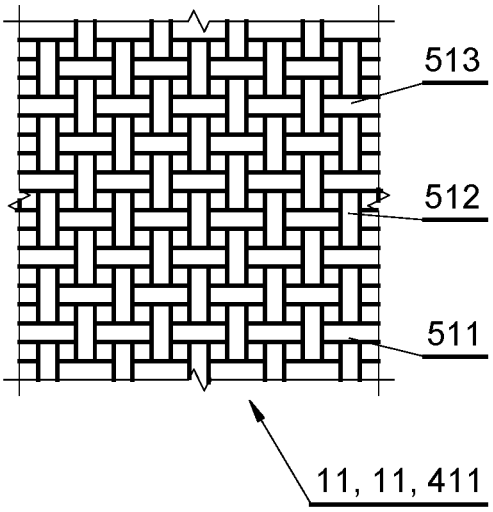
FIGS. 9 and 10 present a woven element in different embodiments.

FIG. 5 presents longitudinal sections of the hand paddle 1 along the longitudinal axis 50 marked on FIG. 1. The fabric 11 in this embodiment is made from treads of natural fibres. In other solutions the treads of synthetic or composite fibres may be used, or the treads may be of natural and synthetic fibres in yet other solutions. In one embodiment, the fabric 11 is made using two thread systems, one of which is a warp thread and the other is a weft thread, which are connected in a specific way, called a weave, creating the structure of the fabric, a more detailed view of which is shown in FIG. 9. In another embodiment, the fabric 11 is knitted fabric, shown in detail in FIG. 10, made using the loop sinking technique, while stitches are pre-folded into loops, or stitches are made from one thread pulled through each consecutive stitch of the previous row, or in a column system, where stitches are made from many threads placed parallel to each other and pulled through previously created stitches, while stitches are formed along the columns.

Figure 6:
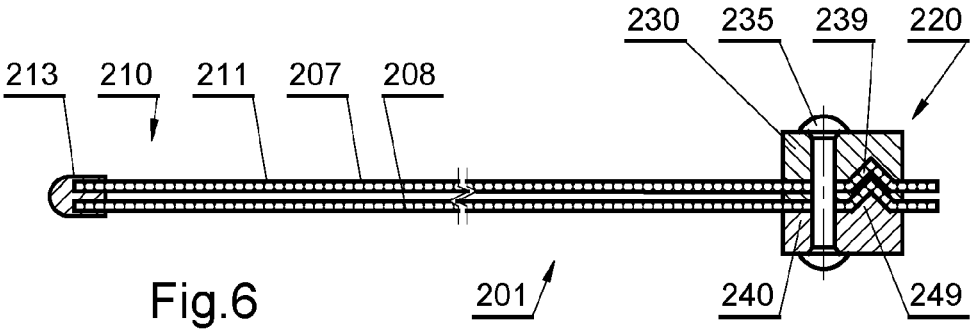

FIG. 6 presents longitudinal section of the hand paddle 201 along its longitudinal axis. The fabric 211 of the flat element 210 placed in the stiffening element 220 between the upper stiffening profile 230 and the bottom stiffening profile 240 is a multi-layer woven element 211 or consists of multiple layers of fabric 207, 208 or of a layer of fabric 208 and a layer of knitted fabric 207, which may have projections which move slightly away from the layer of fabric under the water reaction. The securing strap 213 is folded onto both sides of the fabric 211. The upper stiffening profile 230 and the lower stiffening profile 240 are joined together inseparably by means of rivets 235 or separably by means of bolts and nuts or screws. In order to increase the force holding the fabric 211, the upper stiffening profile 230 has a recess 239, and the lower stiffening profile 240 has a bulge 249.

Figure 7:
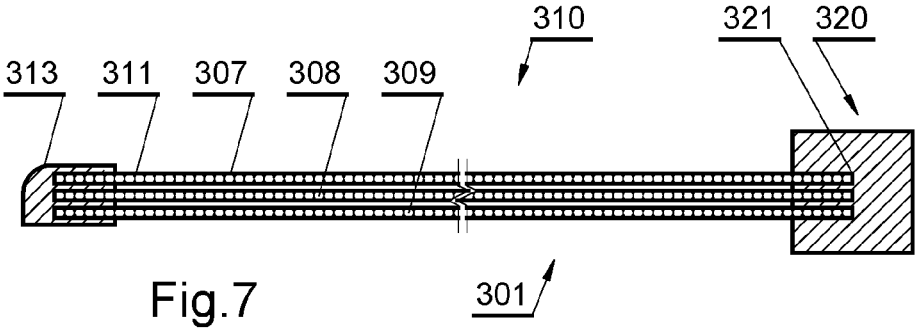

FIG. 7 presents a longitudinal section of the hand paddle 301 along its longitudinal axis. The fabric 311 of the flat element 310 contained in the frame 321 of the stiffening element 320 is a multi-layer woven element 311 or consists of multiple layers of fabric 307, 308 and 309 chosen from the woven elements set. The securing strap 313 or security strip covers the periphery or rim of a rear of the fabric 311 and is folded around a rear edge of the fabric 311.

Figure 8:
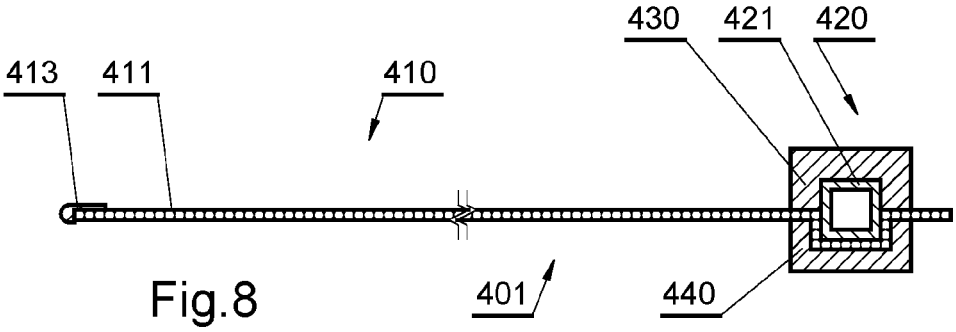

In turn, FIG. 8 presents a longitudinal section of the hand paddle 401, which is similar to the hand paddle 1 in FIG. 5. The difference lies in the fact, that the pressing down element 421 is made from a rectangular profile which is hollow and therefore the flat element 410 with the fabric 411 placed in the stiffening element 420 has a smaller weight than the weight of flat element 10 of the paddle 1. Furthermore, the securing strip 413 is partly folded onto the other side of the fabric 411, which is on the side of the fabric coming into contact with the swimmer's hand, and the upper stiffening profile 430 and the bottom stiffening profile 440 are made of profiles made from plastic, glass fibre or light metal alloys of a channel shape.

FIG. 9 presents a woven element 511 made using two thread systems, one of which is a warp thread 512, and the other is a weft thread 513, which are connected in a specific way, called a weave, creating the structure of the fabric 11, 111, 411. The parameters defining the fabric in this case are the weave, the number of warp and weft threads which influence the flexibility and permeability of the fabric, the weaving of warp and weft and the thickness of the thread. Depending on the chosen parameters the fabric may be less or more stiff and less or more thick, which impacts on the water resistance force during swimming and on the swimmer's effort. Apart from openings or eyelets or micro-eyelets created between the threads, the fabric may have additional eyelets or openings made in the fabric, whose edges are protected against fraying.

Figure 10:
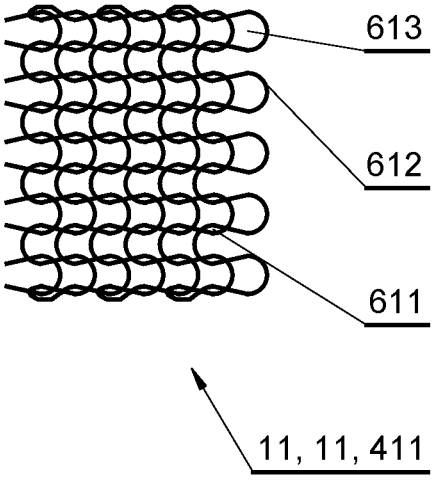

In turn FIG. 10 presents a woven element 611, which is knitted fabric made using a loop sinking technique 612, while stitches are pre-folded into loops, or stitches are made from one thread pulled through each consecutive stitch of a previous row, or in a column system, where stitches are made from many threads placed parallel to each other and pulled through previously created stitches, while stitches are formed along the columns. Knit weave types influence the characteristics of the fabric, such as thickness, weight and finish. The knitted fabric may be braided in such a way to create stitches 613, whose size depends mainly on the type of the weave and the thickness of the thread 612. Where the hand paddle applies a lot of pressure on the water, the knots in the weaves become tighter, therefore the openings or eyelets formed from stitches 613 enlarge, allowing the water to flow through the stitches more freely, which in turn decreases the water resistance, while the swimmer's effort increases only slightly.

Figure 11:
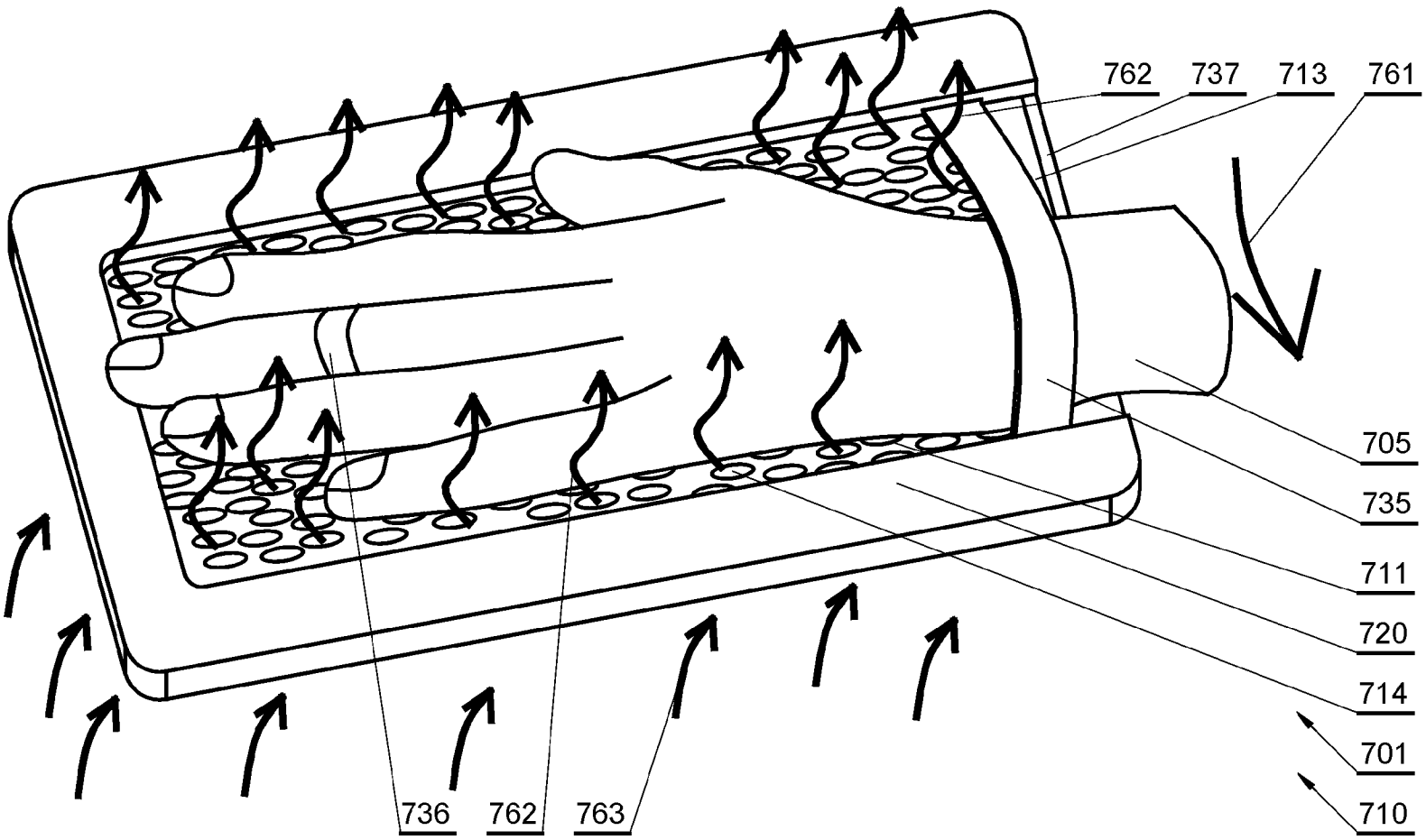
FIG. 11 presents a hand paddle attached to a swimmer's hand.

FIG. 11 presents the hand paddle 701 with the flat element 710 of a polygon-shaped contour and a polygon-shaped stiffening element 720 closed with a bar 737 placed below the securing strap or strip 713, therefore the frame of the hand paddle is of a closed shape or a polygon. The stiffening element 720 may be made together with the bar 737 as a single plastic element. The hand paddle 701 is attached to the swimmer's hand with an attachment strip or strap 735 and an attachment cord 736. The flat element 710 in this embodiment is the fabric 711 with openings or eyelets 714 allowing water to flow through the hand paddle. During the movement of the swimmer's hand 705 in the direction of an arrow 761, the hand paddle shows resistance which changes depending on the size of the openings or eyelets 714 in the fabric 711, through which water flows in the direction of arrows 762. The hand paddle's resistance may be changed by changing the fabric, which may have smaller or bigger openings or eyelets, by changing the number of layers of woven or knitted elements or a surface largeness of the hand paddle. Water which does not flow through the fabric flows around the hand paddle 701 in the direction of arrows 763.

Figure 12:
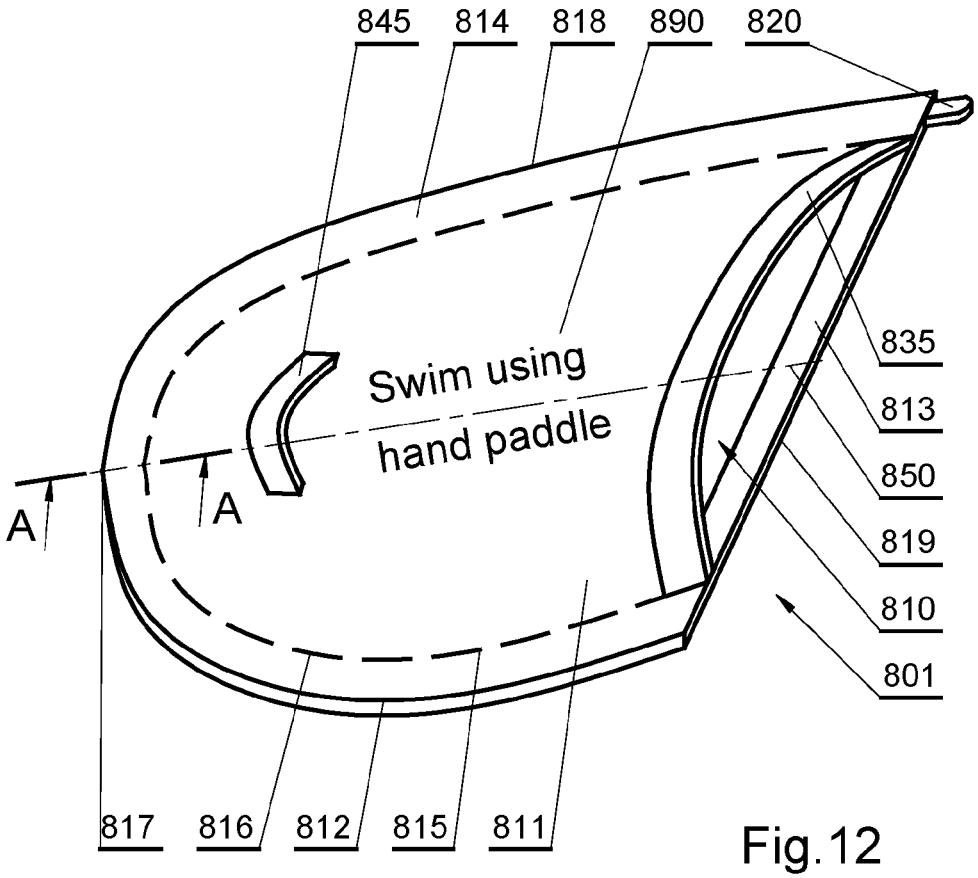
FIG. 12 presents another embodiment of a hand paddle.

FIG. 12 presents another embodiment of the hand paddle 801 with the flat element 810 with a contour given by shape of the fabric 811 and having the axis 850. The fabric 811 is folded along the front 817 and along the sides 818. After folding, two or more layers of the fabric are sewn together using a seam 815, for example with threads 816, creating a tunnel 814 or tubing made of fabric 811 along the periphery or rim 812 of the hand paddle 801. The stiffening element 820 is inserted into the tunnel 814. The stiffening element 820 is an oblong, flexible or flexibly-deformable element. The stiffening element 820 having been inserted into the tunnel 814 takes the shape of the tunnel, and while being a flexibly-deformable element it tends to take the original shape of the lineal profile, therefore stretches out the fabric 811 making it into the flat element 810 with the flattened-arch-shaped stiffening element 820. The rear 819 of the fabric is secured with the securing element 813. In addition, the hand paddle has an attachment strip 835 and an attachment cord 845 or a narrow attachment strip or strap. In the central part of the fabric 811 there is an area 890 intended for advertisement, for example, to place a sentence "Swim using hand paddle".

Figure 13:
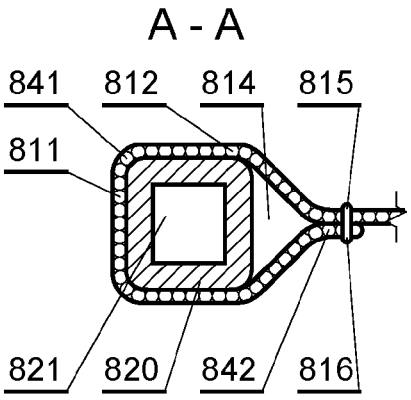
FIGS. 13 and 14 present sections of a rim or periphery of the hand paddle.

The cross-section of the hand paddle presented in FIG. 13 shows that in this embodiment the stiffening element 820 is a profile with a chamber 821 inside it. The profile may have a polygon-shaped cross-section, for example square-shaped, with rounded corners. The folding 841 of the fabric wraps around the stiffening element and turns into a second layer 842 of the fabric, which is sewn together with an upper layer with the seam 815, for example with the threads 816.

Figure 14:
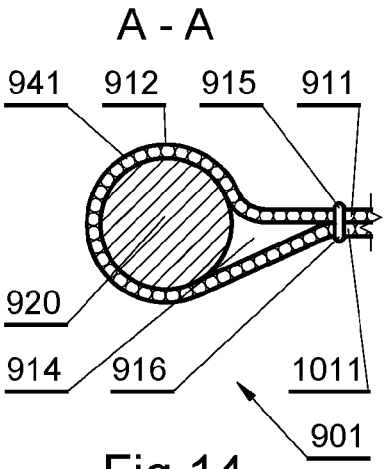

FIG. 14 presents the cross-section of the hand paddle 901 with the stiffening element 920 that has a circular cross-section and the fabric 911 has two layers. Both layers of the fabric 911 after folding are sewn together by a seam 915, for example with threads 916 along the periphery or rim 912 in order to create a fold 941, for example a tunnel 914, in which the stiffening element 920 is placed. The stiffening element may be made from material with elastic properties, such as carbon fibre, spring steel, light metal alloys, plastics.

The embodiments of the hand paddle, especially the embodiments shown in FIGS. 12, 13 and 14, are cheaper than the embodiment of currently available hand paddles made from plastics which require an appropriate mould. In the case of the hand paddle constituting this invention, after creating the tunnel along the sides and the front by sewing the fabric along the periphery or rim, the stiffening element is inserted into the tunnel, in the form of a bar or profile with a cross-section corresponding to the cross-section of the tunnel, while the protruding part of the bar or profile is cut. Before inserting the stiffening element into the tunnel, the tunnel may be sewn at one end, then the bar or profile is inserted into the tunnel until it reaches the sewn end of the tunnel. After cutting off the protruding part of the bar or profile, the tunnel may be sewn at the other end in order to prevent the bar or profile from falling out.

The embodiment of the invention has been presented in selected embodiment examples. Those examples are not exhaustive. Obviously, modifications may be made without affecting the nature of the solution. The embodiment examples presented do not exhaust application possibilities of the solution according to the invention.

LIST OF REFERENCE SIGNS

1, 101, 201, 301, 401, 701, 801 Hand paddle
10, 110, 210, 310, 410, 710, 810 Flat element
11, 111, 211, 311, 411, 711, 811, 842, 911, 1011 Fabric
12, 112, 812, 912 Periphery/Rim
13, 113, 213, 313, 413, 713, 813 Securing strap
14, 714 Openings/Eyelets
16, 116, 736 Attachment element/Plastic cord
17, 117, 817 Front
18, 118, 818 Side
19, 119, 819 Rear
20, 120, 220, 320, 420, 720, 820, 920 Stiffening element
21 Central pressing panel
30, 130, 230, 430 Upper stiffening profile
40, 140, 240, 430 Lower stiffening profile
41 End
42 Groove
43 Groove's external wall
44 Groove's internal wall
50, 850 Longitudinal axis
121 Central stiffening profile
127 Attachment system
131, 135, 145, 735, 835, 845 Attachment strip/Strap
207, 208 Fabric layer
235 Rivet/Screw/Bolt
239 Recess
249 Projection/Bulge
321 Frame of the stiffening element
421 Pressing down element 511,
511, 611 Woven/Knitted element
512 Warp thread
513 Weft thread
612 Thread
613 Stitches
737 Bar
761, 762, 763 Arrow
814, 914 Tunnel/Tubing
815, 915 Seam
816, 916 Seam thread
821 Stiffening element chamber
841, 941 Fold of the fabric
890 Area intended for advertisement

The invention claimed is:

1. A hand paddle configured to be worn on a hand of a user while swimming in water, comprising:
a flexible fabric layer,
wherein the fabric layer is configured to overlie and extend outward beyond fingers of the hand when the paddle is worn by the user,
a frame,
wherein the frame is stiffer than the fabric layer,
wherein the frame extends at and is attached to the fabric layer adjacent a periphery of the fabric layer,
wherein the fabric layer at least one of
extends within the frame, and
surrounds the frame,
wherein the frame consists of a frame that extends continuously on a front side and on two lateral opposed sides
wherein the frame is configured such that when the paddle is worn by the user the front side extends beyond the fingers and each of the two lateral opposed sides are disposed of the hand,
at least one first strip,
wherein the at least one first strip extends across the rear side of the fabric layer and is in operative connection therewith,
wherein the at least one first strip is configured to hold the hand in engagement with the paddle when the hand is extended between the at least one first strip and the rear side of the fabric layer,
at least one second strip,
wherein the at least one second strip is disposed from the at least one first strip and is in operative connection with the fabric layer,
wherein the at least one second strip is configured to hold at least one finger of the hand in operative engagement with the fabric layer when the at least one finger is extended between the at least one second strip and the fabric layer while the hand extends between the at least one first strap and the rear side of the fabric layer,
wherein the paddle includes at least one of,
a pressing panel,
wherein the pressing panel extends within the frame and deforms and holds the fabric layer within the frame, and
a stiffening profile bounding an edge of the fabric layer,
wherein the stiffening profile is captured within the frame to hold the fabric layer in engagement therewith.

2. The hand paddle according to claim 1,
wherein the paddle includes a securing strap, wherein the securing strap is operatively engaged with the rear side of the fabric layer,
wherein the securing strap is in overlying relation of the at least one first strip and is configured to enable a hand to be extended between the securing strap and the at least one first strip.

3. The hand paddle according to claim 1,
wherein the fabric layer includes a plurality of openings therethrough.

4. The hand paddle according to claim 1,
wherein the fabric layer includes a plurality of layers of woven or knitted fabric.

5. The hand paddle according to claim 1,
wherein the frame comprises a pair of separable frame portions, and
wherein the fabric layer extends between the pair of separable frame portions.

6. The hand paddle according to claim 1,
wherein the fabric layer includes a tunnel, and
wherein the frame extends in the tunnel.

7. The hand paddle according to claim 1,
and further comprising:
a tunnel
wherein the tunnel is integrally formed with the fabric layer and wherein the frame extends in and is movably positionable within the tunnel.

8. The hand paddle according to claim 1, wherein the fabric layer includes an advertising area bearing printed advertising.

9. The hand paddle according to claim 8 wherein the fabric layer has a planar side, wherein the at least one first strip and the at least one second strip extend transversely outward from the planar side, wherein the advertising area is located on the planar side.

10. The hand paddle according to claim 8 wherein the fabric layer has opposed generally planar sides wherein at least one of the at least one first strip and at least one of the at least one second strip extends on each of the opposed planar sides of the fabric layer, wherein the hand paddle is enabled to be selectively worn with either planar side of the fabric layer facing the hand.

11. A hand paddle configured to be worn on a hand of a user while swimming in water, comprising:

a flexible fabric layer, wherein the fabric layer is configured to overlie and extend outward beyond fingers of the hand when the paddle is worn by the user, a frame, wherein the frame is stiffer than the fabric layer, wherein the frame extends at and is attached to the fabric layer adjacent a periphery of the fabric layer, wherein the frame consists of a frame that extends continuously on a front side and on two lateral opposed sides, wherein the frame is configured such that when the paddle is worn the frame extends beyond the fingers of the hand on the front side and the frame extends on each of the lateral opposed sides beyond the hand, wherein the frame comprises a pair of separable frame portions, wherein the fabric layer extends between the pair of separable frame portions, wherein the fabric layer extends between the engaged frame portions and is held therebetween by at least one of a pressing panel that deforms the fabric layer within the engaged frame portions, and a stiffened profile bounding an edge of the fabric layer that extends between the engaged frame portions, at least one first strip, wherein the at least one first strip extends across a rear side of the fabric layer and is in operative connection therewith, wherein the at least one first strip is configured to hold the hand in engagement with the paddle when the hand is extended between the at least one first strip and the rear side of the fabric layer, at least one second strip, wherein the at least one second strip is disposed from the at least one first strip and is in operative connection with the fabric layer, wherein the at least one second strip is configured to hold at least one finger of the hand in operative engagement with the fabric layer when the at least one finger is extended between the at least one second strip and the fabric layer while the hand extends between the at least one first strap and the rear side of the fabric layer, a securing strap, wherein the securing strap is operatively engaged with the rear side of the fabric layer, wherein the securing strap and the at least one first strip are configured to have the hand extend between the securing strap and the at least one first strip when the paddle is worn.

12. The hand paddle according to claim 11 and wherein the fabric layer has opposed generally planar fabric sides wherein at least one of the at least one first strip and at least one of the at least one second strip extends on each of the opposed planar fabric sides of the fabric layer, wherein the hand paddle is enabled to be selectively worn with either planar fabric side of the fabric layer facing the hand.

13. The hand paddle according to claim 11 wherein the fabric layer includes an advertising area bearing printed advertising.

14. The hand paddle according to claim 11 wherein the fabric layer includes a plurality of layers of woven or knitted fabric.

15. The hand paddle according to claim 11 wherein the at least one first strip comprises an elastic strip, and wherein the at least one first strip is attached to one of the frame or the fabric layer.

16. A hand paddle configured to be worn on a hand of a user while swimming in water, comprising:

a fabric layer, including at least one flexible layer of fabric, wherein the fabric layer has a front, a rear and two opposed edge sides, and is configured to overlie the hand when worn, a frame, wherein the frame is in operative connection with the fabric layer, wherein the frame comprises a pair of separable frame portions, and the fabric layer extends between the pair of separable frame portions, wherein the frame is stiffer than the fabric layer and consists of a frame that extends continuously about the front and two opposed edge sides, at least one first strip, wherein the at least one first strip is attached to at least one of the frame and the fabric layer, wherein the at least one first strip extends across a rear side of the fabric layer and is configured to receive the hand between the fabric layer to the at least one first strip to enable the paddle to be worn, at least one second strip, wherein the at least one second strip is disposed toward the front relative to the at least one first strip, wherein the at least one second strip is in operative connection with the fabric layer and is configured to receive at least one finger of the hand between the fabric layer and the at least one second strip, wherein the at least one second strip is configured to hold at least one finger of the hand in operative engagement with the fabric layer when the paddle is worn.

* * * * *